US006889799B2

(12) United States Patent
Tyni et al.

(10) Patent No.: US 6,889,799 B2
(45) Date of Patent: May 10, 2005

(54) METHOD FOR SOLVING A MULTI-GOAL PROBLEM

(75) Inventors: Tapio Tyni, Hyvinkää (FI); Jari Ylinen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 241 days.

(21) Appl. No.: 10/642,623

(22) Filed: Aug. 19, 2003

(65) Prior Publication Data

US 2004/0060776 A1 Apr. 1, 2004

Related U.S. Application Data

(63) Continuation of application No. PCT/FI02/00136, filed on Feb. 19, 2002.

(30) Foreign Application Priority Data

Feb. 23, 2001 (FI) ..... 20010370

(51) Int. Cl.[7] ..... B66B 1/18
(52) U.S. Cl. ..... 187/282; 187/247
(58) Field of Search ..... 187/380, 382, 187/387, 391, 393, 247, 248, 902, 910; 706/13, 21, 902, 903, 910

(56) References Cited

U.S. PATENT DOCUMENTS 5,331,121 A * 7/1994 Tsuji ..... 187/388
5,394,509 A 2/1995 Winston
5,529,147 A * 6/1996 Tsuji ..... 187/382
5,612,519 A 3/1997 Chenais
5,780,789 A * 7/1998 Tsuji ..... 187/382
5,932,852 A * 8/1999 Tyni et al. ..... 187/382
6,000,504 A * 12/1999 Koh et al. ..... 187/382
6,439,349 B1 * 8/2002 Smith ..... 187/382

FOREIGN PATENT DOCUMENTS

EP 0 897 891 A1 2/1999
FI 102268 B 11/1998
FI 107379 B 7/2001
JP 06171845 A * 6/1994 ..... B66B/1/18

OTHER PUBLICATIONS

"Generic algorithms in control systems," Kone Elevators Research Center, by Tapio Tyni, Jari Ylinen, pp. 1–7, Feb. 1999.

Coello, Carlos A., "A Comprehensive Survey of Evolutionary–Based Multiobjective Optimization Techniques," Knowledge and Information Systems. An International Journal, vol. 1, Issue 3, pp. 269–308, Aug. 1999.

* cited by examiner

*Primary Examiner*—Jonathan Salata
(74) *Attorney, Agent, or Firm*—Birch, Stewart, Kolasch & Birch, LLP

(57) ABSTRACT

The invention concerns a method for solving an optimization task consisting of a plurality of sub-functions in the control of the operation of an apparatus. In the method, a set of a plurality of solution alternatives is generated and, according to the method, each sub-function is normalized. Normalized cost functions of the sub-functions are generated for each solution alternative for solving the optimization task, and based on the normalized cost functions of the sub-functions, a set of solutions to the optimization task is formed. From the set of solutions, the best solution is selected and the apparatus is controlled in accordance with the solution thus selected.

9 Claims, 3 Drawing Sheets

METHOD FOR SOLVING A MULTI-GOAL PROBLEM

Figure 1:
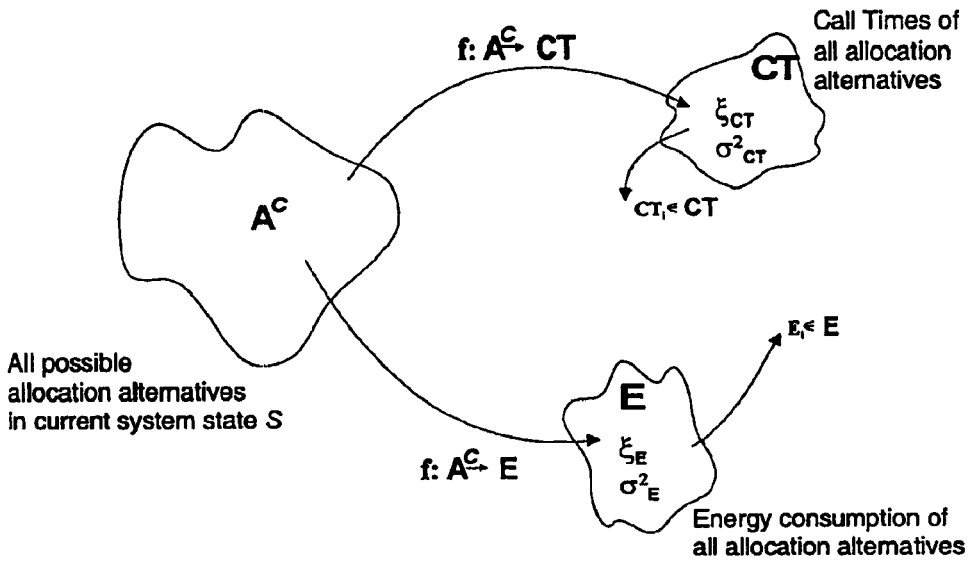

This nonprovisional application is a Continuation application and claims priority under 37 C.F.R. §1.53(b) of PCT International Application No PCT/FI02/00136 filed on Feb. 19, 2002 and claims priority under 35 U.S.C. §119(a) on Patent Application No(s). 20010370 filed in Finland on Feb. 23, 2001, all of which are herein incorporated by reference.

The present invention relates to a method as defined in the preamble of claim 1.

When the most advantageous alternative is to be selected in a situation where the final result depends on a plurality of factors, there often arises a conflict regarding the emphasis to be given to different factors. When the properties and ways of action of different factors are similar and commensurable, it is generally easy to develop methods in which the factors are mutually correctly weighted and the changes occurring in them are properly taken into account.

For example, to optimize the way in which an elevator or elevator group serves a call issued by a passenger, the traditional approach is to calculate the delays and passenger waiting times. By using coefficients, it is possible to control the degree of importance assigned to the passenger's waiting time at a floor, the passenger's traveling time in an elevator car and the stops during the travel of the car proposed for the passenger. As all these factors are quantities of time, comparing and matching them to each other will not involve insuperable difficulties. The goals of optimization can also be easily changed.

When the factors to be optimized at the same time are not commensurable, it is difficult to compare them and to take them equally into consideration. It may be possible to accurately determine the share of individual factors in a cost function. However, different factors may have different degrees of influence, their effects on the matter as a whole may appear on quite different levels, and these effects may even be conflicting. Thus, optimizing the cost function so as to reach a desired goal is a very extensive and multi-dimensional process.

In the allocation of elevator calls, the objective may be to serve the passenger having pressed a call button as soon as possible and to transport the passenger to the destination floor without delay. On the other hand, the elevator control system must take into account the calls and expectations of other elevator passengers as well. Furthermore, the elevator or elevators is/are designed to take care of all internal transportation needs within the building, so the allocation of an individual call is subject to additional conditions relating to traffic situation, traffic intensity and available capacity. If the elevator control system additionally has to take into account the minimization of energy consumption, aim at reducing the number of starts of the elevator or park any elevators that may be free in the current traffic situation at certain floors by considering overall advantages, then managing the cost function by prior-art methods is an impossible task.

The object of the invention is to disclose a new method for optimizing a solution to a problem situation in which the solution is influenced by a plurality of factors that are not commensurable quantities. To achieve this, the method of the invention is characterized by the features presented in the characterization part of claim.

By the method of the invention, a multi-goal optimization problem can be solved quickly and reliably so that different factors contributing to the optimization are weighted in a desired manner. The computation time needed in the optimization can be limited to a short time so that, in situations where the computing time is limited, alternative solutions are considered when a decision is being made. E.g. in elevator group control applications, in which allocation decisions have to be made repeatedly and for constantly changing cost functions, speed and efficiency are of primary importance.

By utilizing the properties of genetic algorithms, subfunctions and overall optimization can be executed advantageously and very quickly with reasonable computing capacity.

Figure 2:
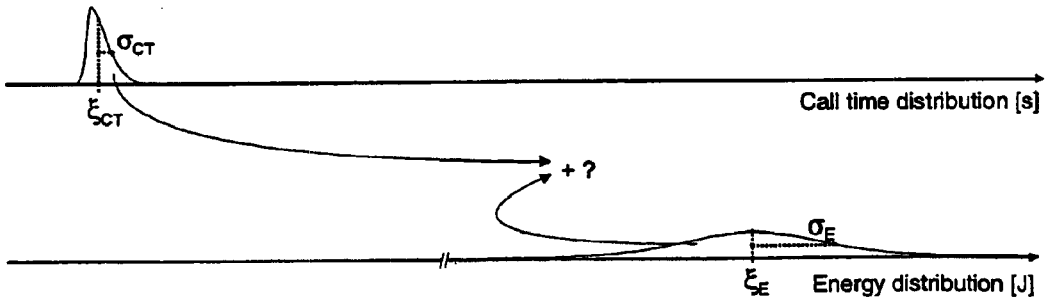
Figure 3:
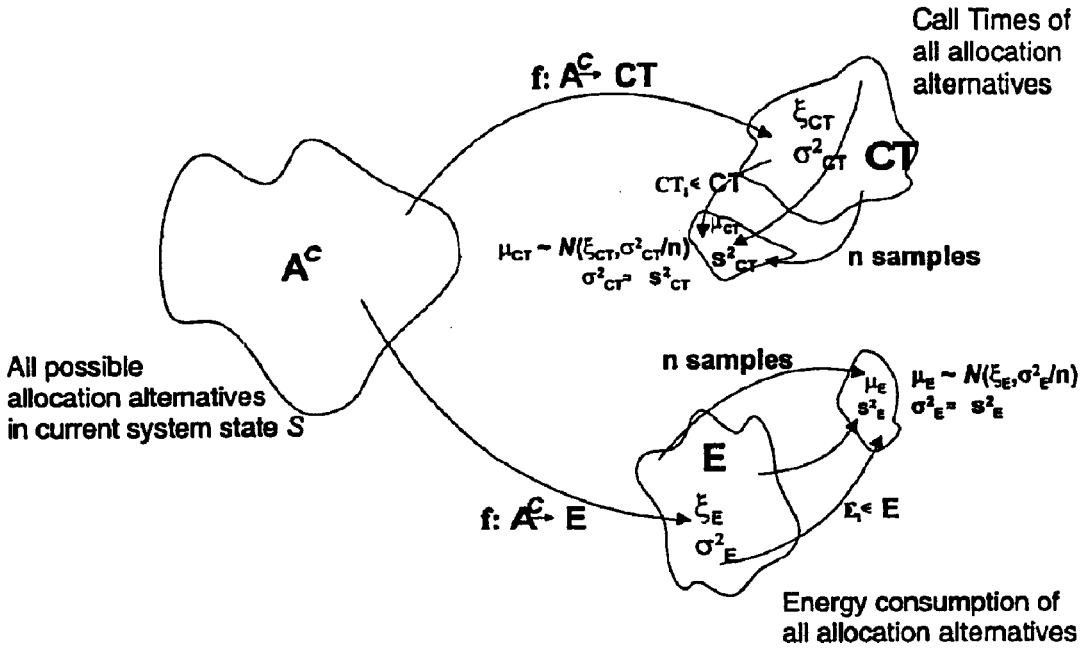
Figure 4:
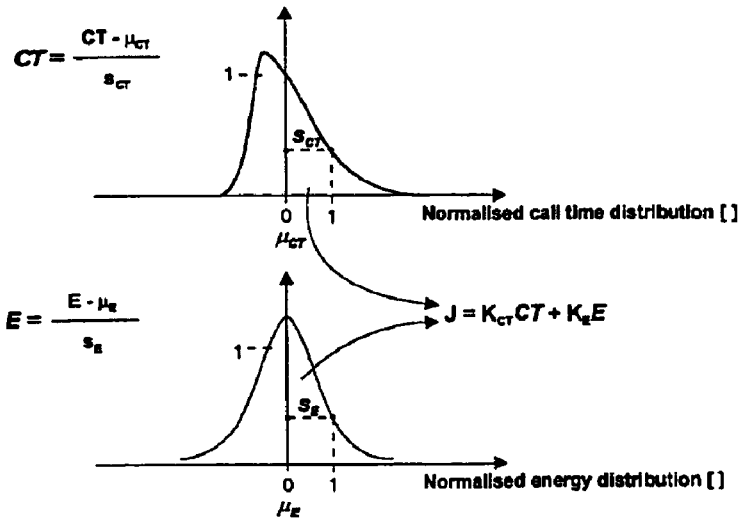
Figure 5:
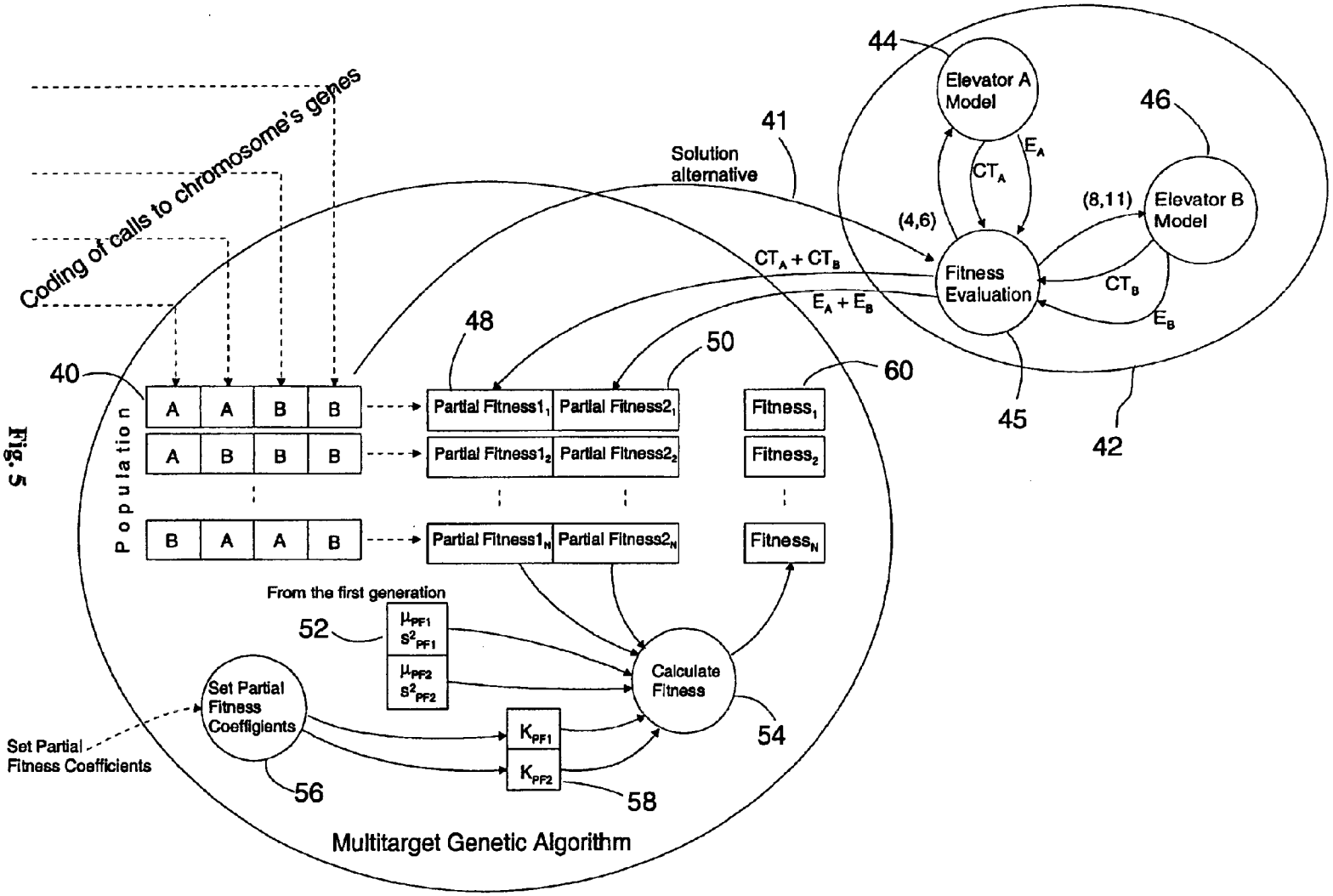

In the following, the invention will be described in detail by the aid of an example of its embodiments with reference to the attached drawings, wherein FIG. 1 visualizes a multi-goal optimization problem FIG. 2 represents the differences between the distributions of the goals of the multi-goal problem FIG. 3 illustrates an approach according to the invention FIG. 4 represents normalized distributions of cost functions FIG. 5 presents an example based on a genetic algorithm according to the invention.

In the following, a solution to a multi-goal problem is described where the objectives are, on the one hand, optimization of energy consumption and, on the other hand, optimization of passengers' call times. In mathematical terms, the optimization problem for solution alternative A of the total cost function J can be expressed by the equation $$J(A)=\Sigma W_I C_I(A),$$

Where $C_I$, represents an individual cost function, in this example call time and energy consumption for alternative A and $W_I$ represents a weighting coefficient assigned to the individual cost function.

In this case, the solution to the optimization problem is minimization of function J. A problematic question is how to define correct values for the weighting coefficients. If a given cost function, such as call time, gets a high weighting, then it will become dominating and the influence of the other factors will remain marginal. Also, a small cost function may have a very small influence.

Referring to FIGS. 1 and 2, let us consider the optimization of passengers' call times and energy consumption of the elevator in the same space $A^C$ of allocation solutions (reference number 1), which contains all possible solutions for serving the calls active in the elevator group. The allocation alternatives can be divided into two sub-spaces CT (2) and E (3) according to their relation to call times on the one hand and to energy consumption on the other hand. These spaces have statistical properties such as distribution, expectation value $\xi$ and variance $\sigma^2$. The statistical properties of these two spaces are described in FIG. 2. In addition to the difference of units of measurement—the unit for call time is second while the unit for energy consumption is Joule—the quantities also differ from each other in respect of statistical properties, as appears from FIG. 2.

Besides being non-commensurable, the targets of optimization are also to be weighted in different ways in different situations. For example, the task may be to find a solution in which energy consumption has a weight of 30% and call times have a weight of 70%.

Theoretically, normalized cost factors $\chi$ can be defined if the expectation value $\xi$ and variance $\sigma^2$ of the cost space are known, by the equation $$\chi=(C-\xi)/\sigma.$$

In practical solutions, such a procedure is not viable because going through the entire space to be considered is a task too laborious and in most cases impossible. Instead, the expectation value and variance can be approximated by using their sample equivalents, sample average $\mu$ and sample variance $s^2$. The normalized cost function can thus be expressed in the form $$\chi=(C-\mu)/s.$$

The sample average $\mu$ is normally distributed with variance $\sigma^2/n$, which can well be used to estimate the required number of samples n. FIG. 3 presents a drawing visualizing the utilization of a sample in the definition of normalized functions. Where applicable, the designations and reference numbers used in FIG. 3 are the same as in FIG. 1. From sub-space 2, a sample 12 has been taken, which contains a certain set of the elements of space 2. In the example of allocation of elevator calls implemented using a genetic algorithm that is described below, this set of samples preferably consists of members of a first generation of solutions. In a corresponding manner, a sample 13 has been taken of sub-space 3. For the samples depicted in FIG. 3, the statistical quantities sample average $\mu$ and sample variance $s^2$ are defined, which approximately describe the statistical quantities expectation value $\xi$ and variance $\sigma^2$ for the entire sub-spaces 2 and 3 in the manner described above.

FIG. 4 visualizes the relationship between the normalized cost functions. As the cost functions are commensurable, they can be added together and their sums can be evaluated by the same criteria. As indicated in FIG. 4, the normalized cost function obtained for call time is $CT=(CT-\mu_{CT})/s_{CT}$ and correspondingly the normalized cost function for energy consumption is $E=(E-\mu_E)/s_E$. The normalized total cost function, which is to be minimized, is correspondingly $$J=K_{CT}CT+K_EE,$$

where $K_{CT}$ and $K_E$ are drive-specific coefficients to be determined separately.

In the following embodiment example, the implementation of multi-goal optimization using a genetic algorithm is described. Below is a short summary of the application of a genetic algorithm to the allocation of elevator calls. For a more detailed description, reference is made e.g. to patent specification U.S. Pat. No. 5,932,852.

When calls are allocated by means of a genetic algorithm, each landing call is encoded as a gene of a call chromosome. The position of the gene in the chromosome represents an active landing call, and correspondingly the value of the gene represents the elevator car proposed to serve the landing call. Each chromosome represents one alternative solution to the allocation problem that is able to serve the active calls. From the chromosomes, a population typically comprising about 50 chromosomes or solution alternatives is formed. For each chromosome in the population is determined a so-called Fitness value, which consists of the sum of the cost functions of the elevators serving active calls. The cost functions are defined on the basis of selected criteria, and their values are computed using a model of each elevator.

After the Fitness values of all the chromosomes have been determined, they are listed in order of Fitness values. From the chromosomes, new generations are formed by genetic algorithm methods. After about 20–50 generations, the best alternative can be found, and this alternative is selected to serve the active landing calls.

FIG. 5 visualizes an example embodiment of the invention in which a multi-goal problem is solved by utilizing both normalization of non-commensurable cost functions and methods of allocation based on a genetic algorithm. As for the formation of chromosomes and computation of the Fitness values, reference is made to patent specification U.S. Pat. No. 5,932,852.

On the basis of the active landing calls and car calls, the chromosomes 40 of the first population are generated, on the basis of which the Fitness values of the allocation alternatives corresponding to the chromosomes are determined, considering both call time optimization CT and energy consumption E, in a computation unit 42. In the example presented in FIG. 5, the elevator group comprises two elevators, elevator A and elevator B. For each elevator, an elevator model 44 and 46, respectively, has been formed, these models comprising the required elevator-specific information for the calculation of the cost functions. Based on this information and the active calls to be served, cost functions are determined in the computation unit for both call times $CT_A$ and $CT_B$ and energy consumption $E_A$ and $E_B$. A cost function CT for the call times of the entire elevator group for a given allocation alternative is obtained as the sum $CT=CT_A+CT_B$, and a cost function E for energy consumption in the entire elevator group is obtained correspondingly from the sum $E=E_A+E_B$. These partial cost functions for call times and energy consumption are stored in tables 48 and 50 of partial Fitness values.

A first population is produced e.g. in the manner described patent specification U.S. Pat. No. 5,932,852. Based on the partial Fitness values of this first population, i.e. on the values of the partial cost functions, sample averages $\mu_{PF1}$ and $\mu_{PF2}$ and sample variances $s^2_{PF1}$ and $s^2_{PF2}$ for a sample according to the first population are determined in the manner specified in FIG. 3 and formulas 1–3. These sample quantities $\mu$ and $s^2$ are used in the calculation of the Fitness value 54 of a chromosome. In the determination of the Fitness value, a weighting coefficient $K_{PF1}$ and $K_{PF2}$ (block 58) defined for the partial cost function by the operator 56, e.g. the owner of the building, is taken into account. The calculated results constitute the total Fitness value of the chromosome and they are stored in a table 60. On the basis of these values, the best solution alternatives of the population are evaluated. In the next populations, the sample quantities $\mu$ and $s^2$ are utilized, which are used to normalize the partial cost functions, whereas the other factors used a basis of calculation change in a manner determined by the genes of the chromosome and the elevator models.

In the embodiment example presented in FIG. 5, the normalization of the partial cost functions and the calculation of the values of the normalized cost functions are performed in block 54, whereas the calculation of the values of the sub-functions, in this case call times and energy consumption, is performed in block 45, taking the call situations and elevator models into account.

What is claimed is:

1. Method for solving an optimization task consisting of a plurality of sub-functions in the control of the operation of the elevator group, in which the optimization task is related to control functions such as allocation of elevator calls in the control of the elevator group in which method a set of plurality of solution alternatives is generated, characterized in that each sub-function is normalized, normalized cost functions of the sub-functions are generated for each solution alternative for solving the optimization task, based on the normalized cost functions of the sub-functions, a set of solutions to the optimization task is formed, from the set of solutions, the best solution is selected, if necessary, a new set of solution alternatives is generated, from which correspondingly the best solution is selected, and the apparatus is controlled in accordance with the solution thus selected.

2. Method as defined in claim 1, characterized in that the sub-functions are normalized by forming an expectation value and variance of the cost function of the sub-function and that the expectation value is subtracted from the cost function and the difference thus obtained is divided by the square root of the variance.

3. Method as defined in claim 1, characterized in that a sample average is used as an approximate value of the expectation value and a sample variance is used as an approximate value of the variance.

4. Method as defined in claim 1, characterized in that at least one of the sub-functions is a function of the time spent by an elevator passenger on a trip in an elevator and at least one of the sub-functions is a function of a quantity associated with elevator group control other than the time spent by an elevator passenger on a trip in an elevator.

5. Method as defined in claim 4, characterized in that genetic algorithm methods are utilized in the optimization.

6. Method as defined in any one of claims 4–5, characterized in that, in the allocation of elevator calls, a first set of solutions is generated, by means of which a sample average and a sample variance are determined.

7. Method as defined in claim 6, characterized in that the sample average and variance determined by means of the first set of solutions are used in the calculation of the cost functions of the sub-functions when the cost functions of the sub-functions of later sets of solutions are being determined.

8. Method as defined in claims 4, characterized in that weighting coefficients of the sub-functions are taken into account in the cost functions of the sub-functions.

9. Method as defined in claim 8, characterized in that the weighting coefficients of the sub-functions have been determined beforehand.

* * * * *